US011161342B2

(12) United States Patent
Toshishige et al.

(10) Patent No.: US 11,161,342 B2
(45) Date of Patent: Nov. 2, 2021

(54) LIQUID DISCHARGE HEAD AND MANUFACTURING METHOD THEREFOR

(71) Applicant: CANON KABUSHIKI KAISHA, Tokyo (JP)

(72) Inventors: Mitsunori Toshishige, Kawasaki (JP); Noriyasu Ozaki, Atsugi (JP); Shiro Sujaku, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 76 days.

(21) Appl. No.: 16/536,025

(22) Filed: Aug. 8, 2019

(65) Prior Publication Data

US 2020/0061995 A1 Feb. 27, 2020

(30) Foreign Application Priority Data

Aug. 24, 2018 (JP) ..... JP2018-157380

(51) Int. Cl.
*B41J 2/14* (2006.01)
*B41J 2/045* (2006.01)
*B41J 2/16* (2006.01)

(52) U.S. Cl.
CPC ..... *B41J 2/14072* (2013.01); *B41J 2/0458* (2013.01); *B41J 2/1626* (2013.01); *B41J 2/1631* (2013.01); *B41J 2202/19* (2013.01); *B41J 2202/22* (2013.01)

(58) Field of Classification Search
CPC ..... B41J 2/14072; B41J 2002/14491
See application file for complete search history.

(56) References Cited

U.S. PATENT DOCUMENTS

2004/0040929 A1 3/2004 Kim
2008/0266362 A1* 10/2008 Aoki ..... B41J 2/04591 347/57
2011/0012960 A1 1/2011 Sakuma
2012/0033017 A1* 2/2012 Iwanaga ..... B41J 2/1623 347/54

(Continued)

FOREIGN PATENT DOCUMENTS

CN 101254693 A 9/2008
CN 103596764 A 2/2014
JP 2017-30283 A 2/2017

*Primary Examiner* — Scott A Richmond
(74) *Attorney, Agent, or Firm* — Canon U.S.A., Inc. IP Division

(57) ABSTRACT

A liquid discharge head includes a recording element substrate including a discharge port configured to discharge a liquid, a pressure generating element configured to pressurize the liquid to discharge the liquid, and an electric connecting portion connected to the pressure generating element through an electric wiring and configured to supply power for driving the pressure generating element to the pressure generating element. The liquid discharge head includes a first recessed portion and a second recessed portion formed in a range from a back surface of a discharge port surface in which the discharge port of the recording element substrate is formed up to the electric connecting portion, and a communicating portion configured to connect a space formed within the first recessed portion and a space formed within the second recessed portion by allowing the first recessed portion and the second recessed portion to communicate with each other.

15 Claims, 11 Drawing Sheets

(56) References Cited

U.S. PATENT DOCUMENTS

| | | | | |
|---|---|---|---|---|
| 2015/0231885 | A1* | 8/2015 | Kumagai | B41J 2/16508 347/29 |
| 2016/0144624 | A1* | 5/2016 | Gejima | B41J 2/14201 347/71 |
| 2017/0038689 | A1 | 2/2017 | Ishikawa | |
| 2017/0066239 | A1* | 3/2017 | Hirai | B41J 2/1623 |
| 2017/0368825 | A1* | 12/2017 | Tanaka | B41J 2/14233 |

* cited by examiner

FIG.6A1
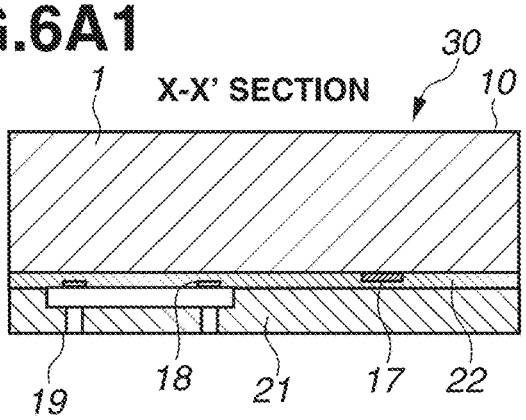
FIG.6A2
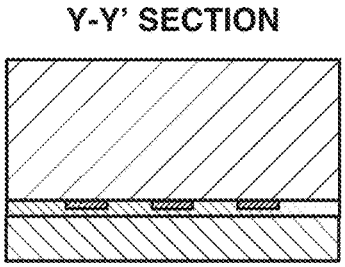
FIG.6B1
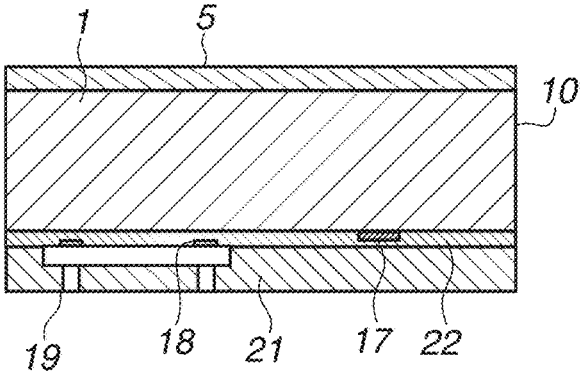
FIG.6B2
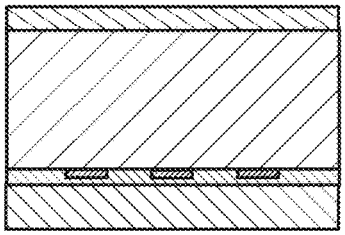
FIG.6C1
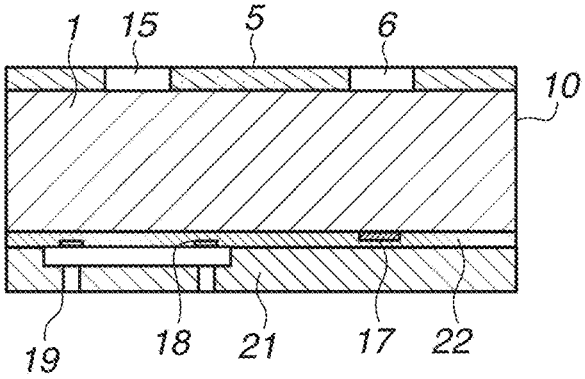
FIG.6C2
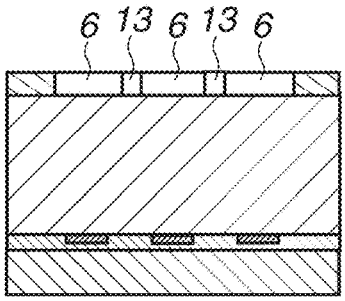
FIG.6D1
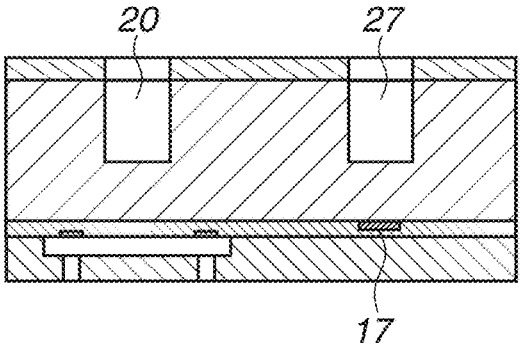
FIG.6D2
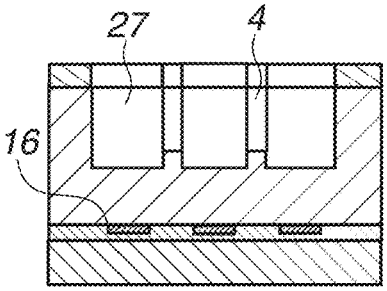

FIG.7A1 X-X' SECTION
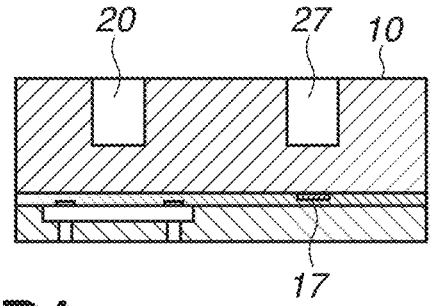
FIG.7A2 Y-Y' SECTION
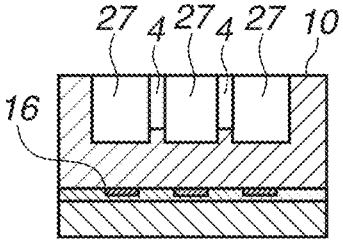
FIG.7B1
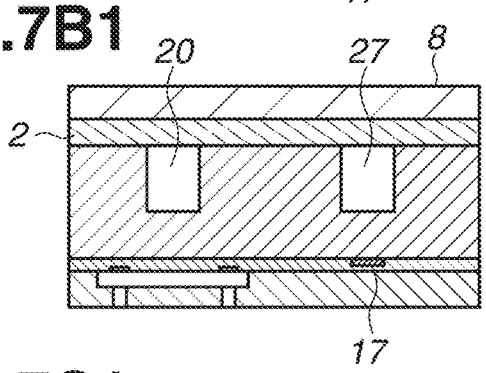
FIG.7B2
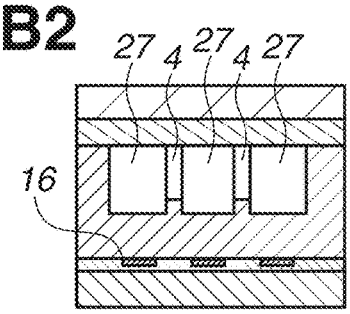
FIG.7C1
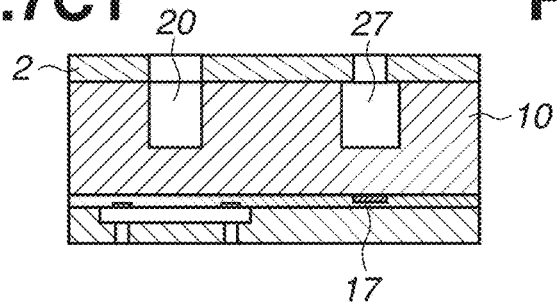
FIG.7C2
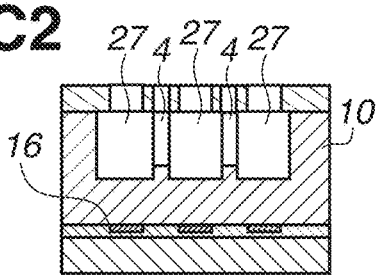
FIG.7D1
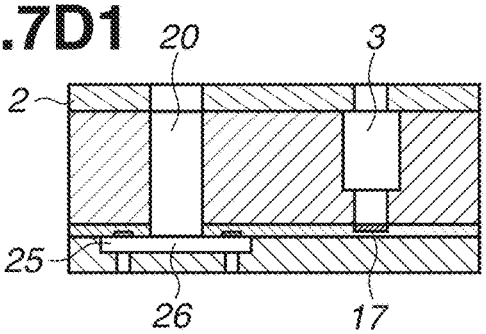
FIG.7D2
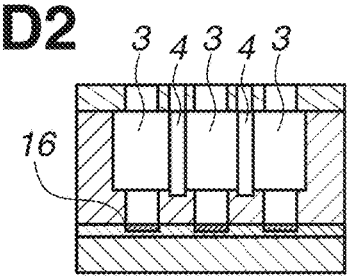
FIG.7E1
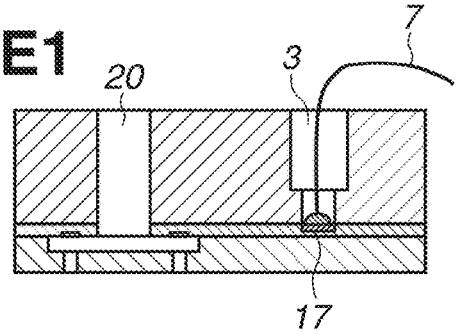
FIG.7E2
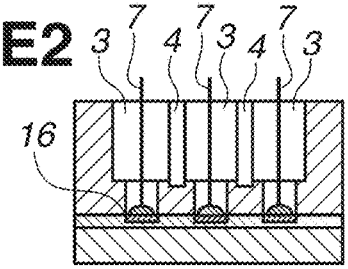

LIQUID DISCHARGE HEAD AND MANUFACTURING METHOD THEREFOR

BACKGROUND OF THE INVENTION

Field of the Invention

The present disclosure relates to a liquid discharge head and a manufacturing method of the liquid discharge head.

Description of the Related Art

Japanese Patent Application Laid-Open No. 2017-30283 discusses a method for manufacturing a liquid discharge head in such a manner that a dry film resist is subjected to tenting on a recording element substrate provided with recessed portions each serving as a channel portion of the liquid discharge head. The dry film resist is subjected to tenting and is then exposed to light, thereby forming, for example, a part of the channel portion.

In the method discussed in Japanese Patent Application Laid-Open No. 2017-30283, if each recessed portion of the recording element substrate is sealed in such a manner that the dry film resist is subjected to tenting, the pressure of air remaining in each recessed portion increases, which may cause peeling-off of the dry film resist subjected to tenting from the recording element substrate.

SUMMARY OF THE INVENTION

According to an aspect of the present disclosure, there is provided a liquid discharge head including a recording element substrate including a discharge port configured to discharge a liquid, a pressure generating element configured to pressurize the liquid to discharge the liquid, and an electric connecting portion connected to the pressure generating element through an electric wiring and configured to supply power for driving the pressure generating element to the pressure generating element, the liquid discharge head including a first recessed portion and a second recessed portion formed in a range from a back surface of a discharge port surface in which the discharge port of the recording element substrate is formed up to the electric connecting portion, and a communicating portion configured to connect a space formed within the first recessed portion and a space formed within the second recessed portion by allowing the first recessed portion and the second recessed portion to communicate with each other.

According to another aspect of the present disclosure, there is provided a manufacturing method of a liquid discharge head, the liquid discharge head including a discharge port configured to discharge a liquid, a pressure generating element configured to pressurize the liquid to discharge the liquid, and an electric connecting portion connected to the pressure generating element through an electric wiring and configured to supply power for driving the pressure generating element to the pressure generating element, the manufacturing method including preparing a recording element substrate including a first recessed portion and a second recessed portion formed in a back surface of a discharge port surface in which the discharge port is formed, and a communicating portion configured to connect a space formed within the first recessed portion and a space formed within the second recessed portion by allowing the first recessed portion and the second recessed portion to communicate with each other, and subjecting a dry film resist to tenting on the back surface of the recording element substrate along an array direction of the first and second recessed portions.

Further features of the present disclosure will become apparent from the following description of exemplary embodiments with reference to the attached drawings.

BRIEF DESCRIPTION OF THE DRAWINGS

FIGS. 6A1 and 6A2 are schematic diagrams each illustrating step 1 illustrated in FIG. 5, FIGS. 6B1 and 6B2 are schematic diagrams each illustrating step 2 illustrated in FIG. 5, FIGS. 6C1 and 6C2 are schematic diagrams each illustrating step 3 illustrated in FIG. 5, and FIGS. 6D1 and 6D2 are schematic diagrams each illustrating step 4 illustrated in FIG. 5.

FIGS. 7A1 and 7A2 are schematic diagrams each illustrating step 5 illustrated in FIG. 5, FIGS. 7B1 and 7B2 are schematic diagrams each illustrating step 6 illustrated in FIG. 5, FIGS. 7C1 and 7C2 are schematic views each illustrating step 7 illustrated in FIG. 5, FIGS. 7D1 and 7D2 are schematic diagrams each illustrating step 8 illustrated in FIG. 5, and FIGS. 7E1 and 7E2 are schematic diagrams each illustrating step 9 illustrated in FIG. 5.

FIG. 9A is a schematic diagram illustrating the recording element substrate including a communicating portion having an opening width that gradually decreases, FIG. 9B is a schematic diagram illustrating the recording element substrate that can be formed with an improved rigidity, and FIG. 9C is a schematic diagram illustrating the recording element substrate that can be formed with an improved rigidity while preventing peeling-off of the dry film resist.

DESCRIPTION OF THE EMBODIMENTS

The present disclosure is directed to a liquid discharge head that prevents peeling-off of a dry film resist subjected to tenting from a recording element substrate, and a manufacturing method of the liquid discharge head.

A liquid discharge head according to an exemplary embodiment of the present disclosure and a manufacturing method of the liquid discharge head will be described below with reference to the accompanying drawings. However, the following exemplary embodiments are not intended to limit the scope of the present disclosure. For example, a thermal method for discharging a liquid by causing a heating element to generate air bubbles is employed for a liquid discharge head in the present exemplary embodiment, but the present disclosure is also applicable to liquid discharge heads that employ a piezoelectric method and other various liquid discharge methods. As the liquid discharge head according to the present exemplary embodiment, a so-called page-wide head having a length corresponding to the width of a recording medium is illustrated. However, the present disclosure is also applicable to a so-called serial liquid discharge head that performs recording on a recording medium while scanning the recording medium. Examples of the configuration of the serial liquid discharge head include a configuration in which a recording element substrate for black ink and a recording element substrate for each color ink are mounted.

(Liquid Discharge Head)

Figure 1:
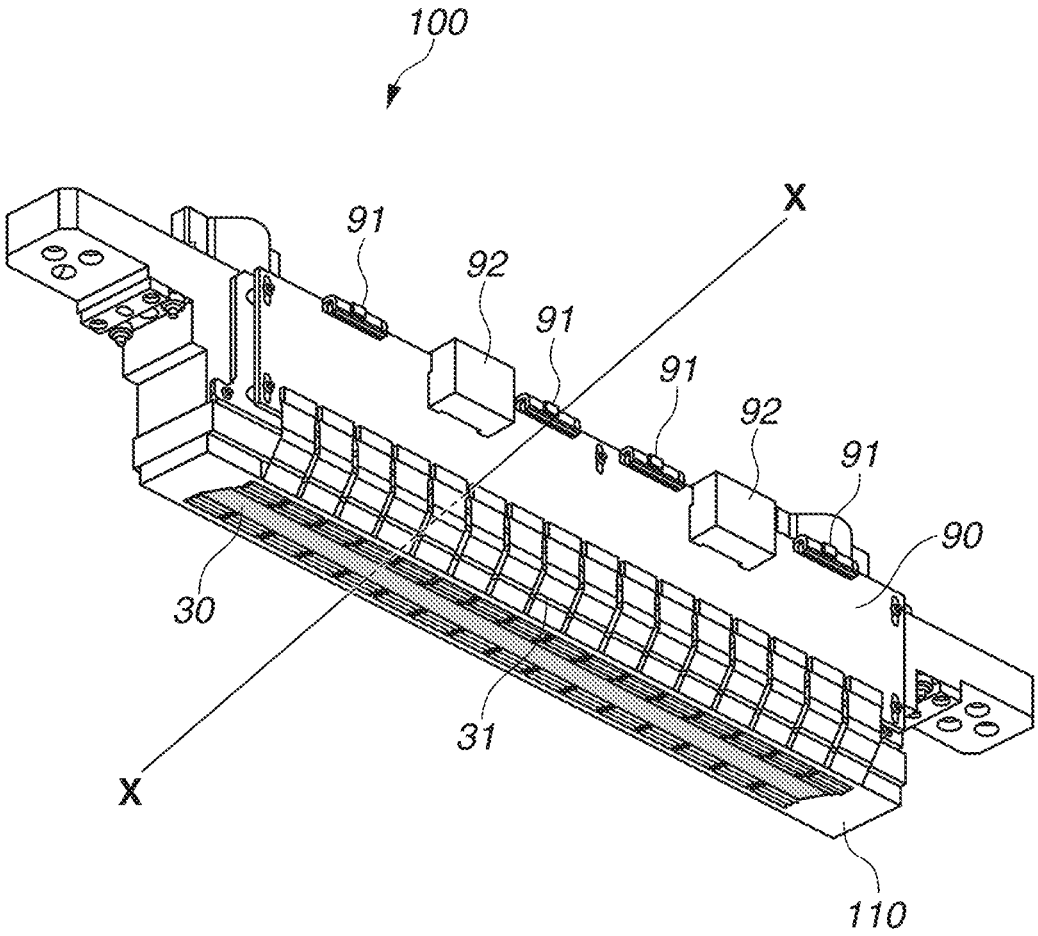
FIG. 1 is a perspective view illustrating a liquid discharge head according to an exemplary embodiment of the present disclosure.

A liquid discharge head according to a first exemplary embodiment will be described below. FIG. 1 is a perspective view illustrating a liquid discharge head 100 according to the present exemplary embodiment. The liquid discharge head 100 according to the present exemplary embodiment is a page-wide liquid discharge head in which 16 recording element substrates 30, which discharges ink of four colors, i.e., cyan (C), magenta (M), yellow (Y), and black (K), are linearly arranged (arranged in line). The liquid discharge head 100 includes the recording element substrates 30, flexible electric wiring members 31, a plate-like electric wiring substrate 90, signal input terminals 91, and power supply terminals 92. Each electric wiring member 31 is, for example, a flexible printed circuit (FPC). Each signal input terminal 91 and each power supply terminal 92 are electrically connected to a conveyance portion (not illustrated) that conveys a recording medium (not illustrated) and a control portion of a recording apparatus body (not illustrated) including the liquid discharge head 100. Each signal input terminal 91 and each power supply terminal 92 are configured to supply discharge drive signals and power necessary for discharge to the recording element substrates 30. Wires are consolidated as an electrical circuit on the electric wiring substrate 90. Thus, the number of the signal input terminals 91 to be installed and the number of the power supply terminals 92 to be installed can be reduced in comparison with the number of the recording element substrates 30. As a result, it is possible to reduce the number of electric connecting portions that are required to be connected or disconnected when the liquid discharge head 100 is attached to or detached from the recording apparatus body.

FIG. 1 illustrates the page-wide liquid discharge head 100 in which the recording element substrates 30 are linearly arranged in a longitudinal direction of the liquid discharge head 100. However, the present disclosure is not limited to this configuration. The present disclosure is also applicable to a page-wide liquid discharge head in which the recording element substrates 30 are arranged in a staggered manner in the longitudinal direction.

(Connection between Recording Element Substrates and Electric Wiring Members)

Figure 2A:
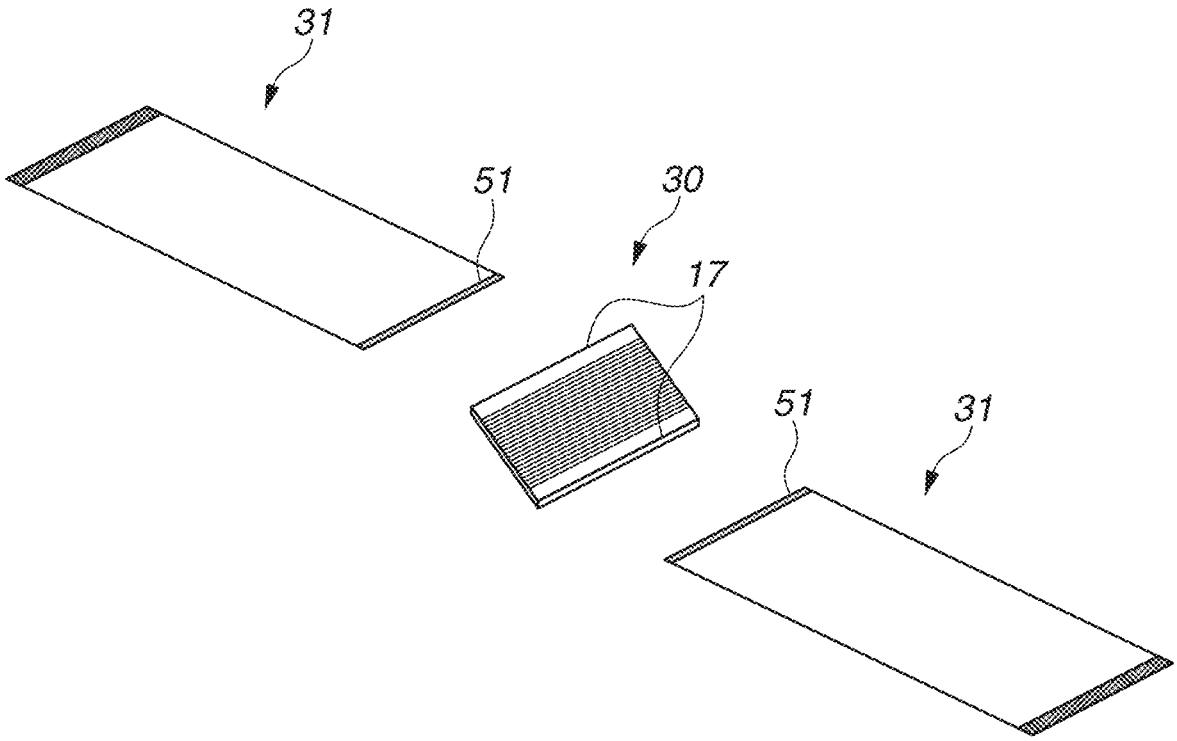
FIG. 2A is a perspective view illustrating a state where a recording element substrate and electric wiring members are not electrically connected yet.
Figure 2B:
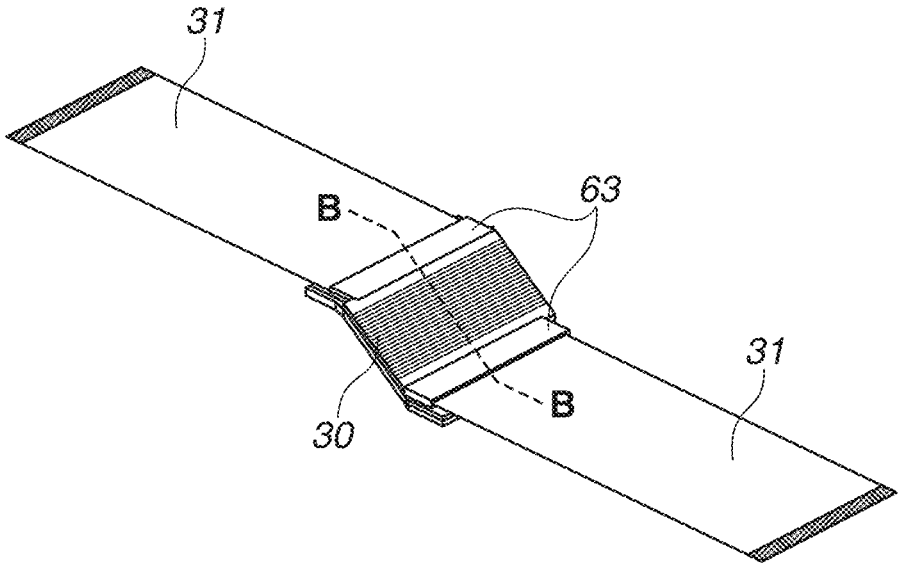
FIG. 2B is a perspective view illustrating a state where the recording element substrate and the electric wiring members are electrically connected.

An electrical connection between the recording element substrates 30 and the electric wiring members 31 will be described with reference to FIGS. 2A and 2B and FIGS. 3A and 3B. FIGS. 2A and 2B are perspective views each illustrating one of the plurality of recording element substrates 30 provided in the liquid discharge head 100 and two of the plurality of electric wiring members 31 provided in the liquid discharge head 100, and each illustrate a back surface of the recording element substrate 30 on which a discharge port is provided (hereinafter referred to simply as the back surface). FIG. 2A is a perspective view illustrating a state where the recording element substrate 30 and the electric wiring members 31 are not electrically connected yet. FIG. 2B is a perspective view illustrating a state where the recording element substrate 30 and the electric wiring members 31 are electrically connected.

Figure 3A:
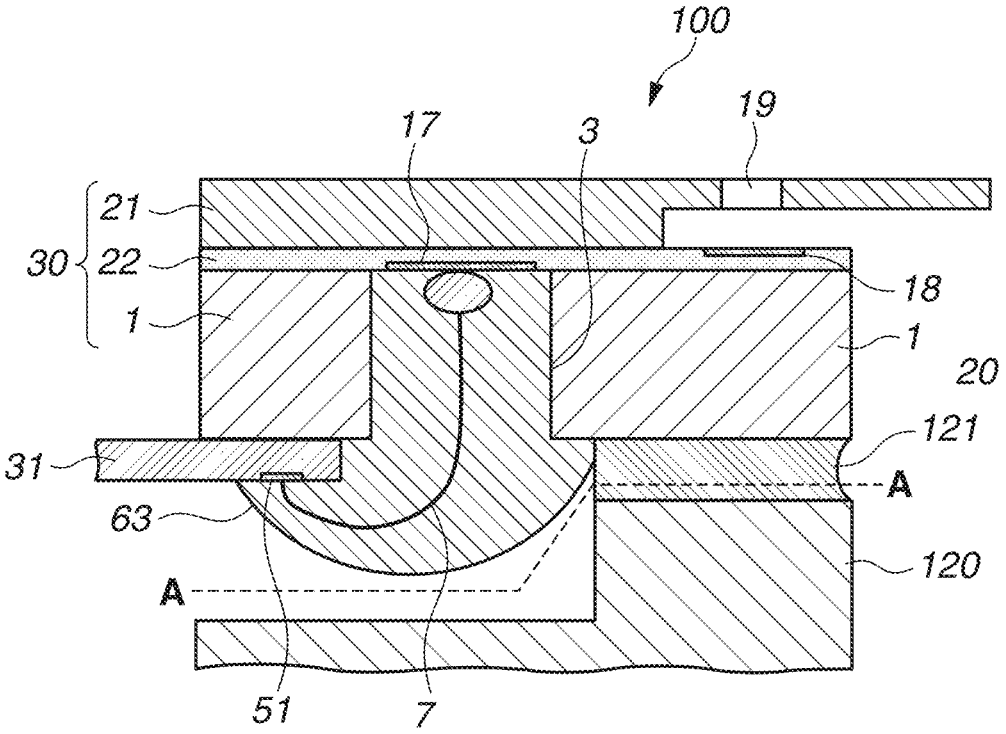
FIG. 3A is a schematic diagram illustrating a part of a section taken along a line B-B illustrated in FIG. 2B.
Figure 3B:
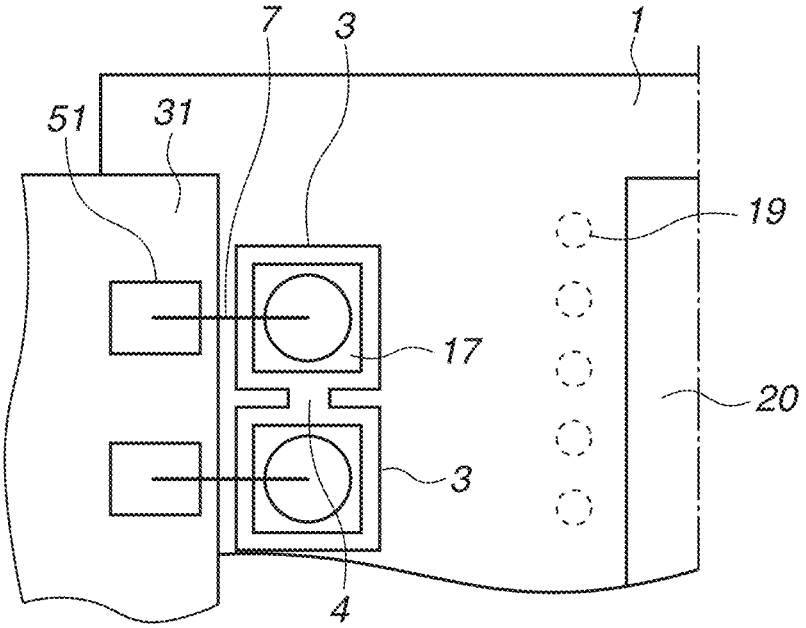
FIG. 3B is a schematic diagram illustrating a part of the recording element substrate as viewed along the line A-A illustrated in FIG. 3A.

In the present exemplary embodiment, as illustrated in FIG. 2B, electric connecting portions 17, which are formed on the back surface of the recording element substrate 30, and terminals 51 of the electric wiring members 31 are electrically connected with a metal wire 7 (FIGS. 3A and 3B). The electric connecting portions are each covered with a sealing member 63 that is filled in each recessed portion 3 (FIG. 2B). In the present exemplary embodiment, the state where the recording element substrate 30 and the electric wiring members 31 are connected as illustrated in FIG. 2B is used as one module, and 16 modules are arrayed to thereby constitute the page-wide liquid discharge head. This module configuration enables providing of a liquid discharge head having a required length as needed by appropriately changing the number of modules to be mounted.

Next, a configuration associated with the electrical connection will be described in detail with reference to FIGS. 3A and 3B. FIG. 3A is a schematic diagram illustrating a part of a section taken along a line B-B illustrated in FIG. 2B. FIG. 3B is a schematic diagram illustrating a part of the recording element substrate 30 as viewed along a line A-A illustrated in FIG. 3A. While a channel member 120 is not illustrated in FIG. 2B, the channel member 120 is illustrated in FIG. 3A for convenience of explanation. The electric wiring member 31 is placed on a base portion 1, and the terminal 51 of the electric wiring member 31 and the electric connecting portion 17 of the recording element substrate 30 are electrically connected by so-called wire bonding. The recording element substrate 30 is closely attached to the channel member 120 through a sealing member 121. Ink is supplied to discharge ports 19 from an ink supply port 20 that is formed in the channel member 120.

(Recording Element Substrate)

Figure 4A:
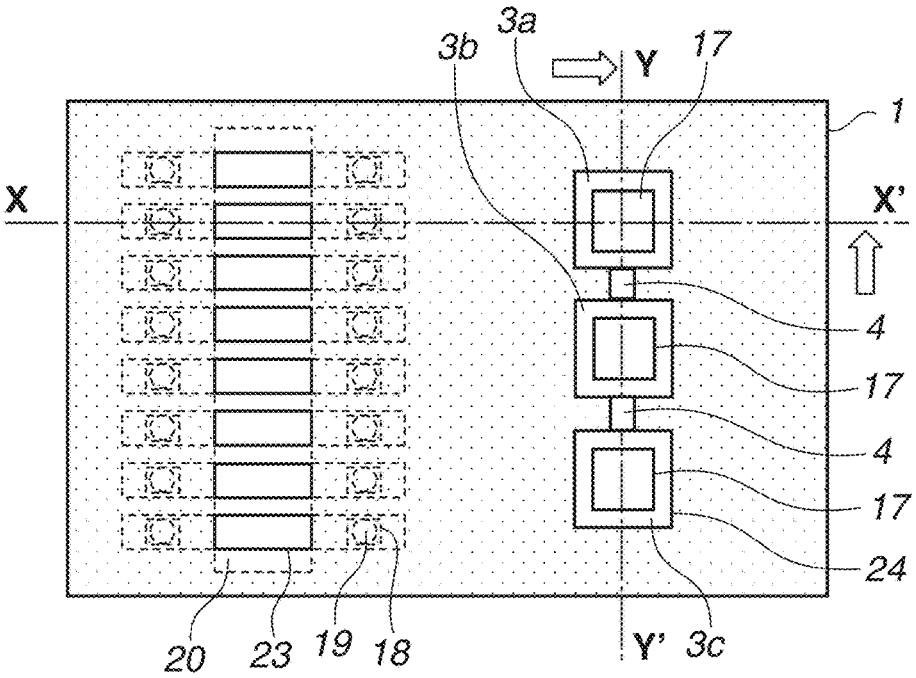
FIG. 4A is a schematic diagram illustrating a top surface of the recording element substrate.
Figure 4B:
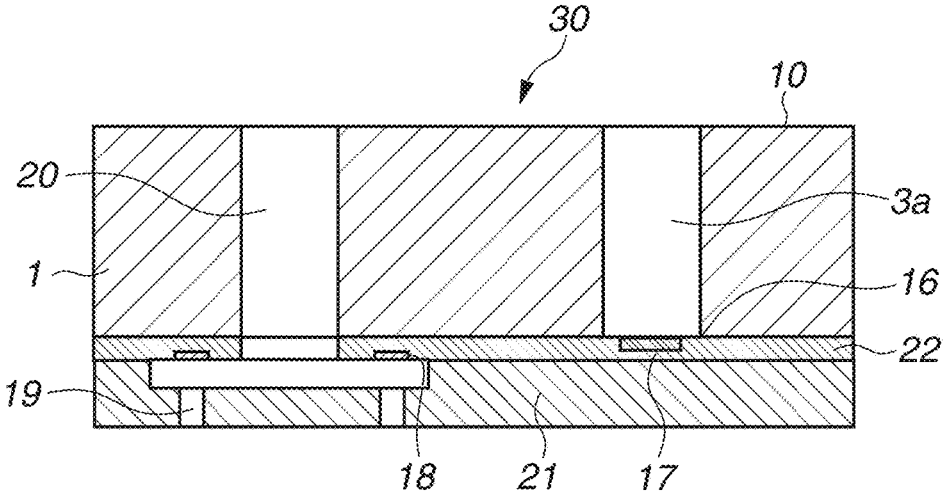
FIG. 4B is a schematic diagram illustrating a section taken along a line X-X' illustrated in FIG. 4A.
Figure 4C:
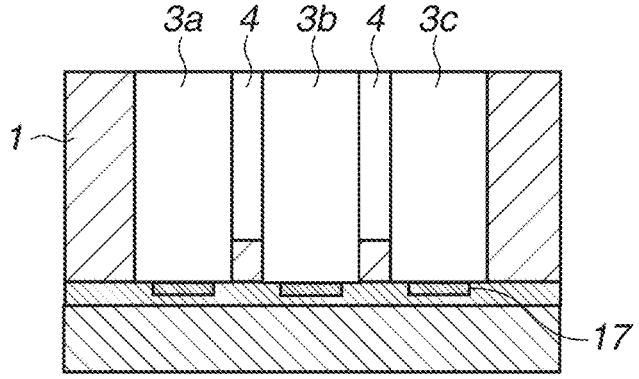
FIG. 4C is a schematic diagram illustrating a section taken along a line Y-Y' illustrated in FIG. 4A.

Each recording element substrate 30, which is a characteristic portion of the present disclosure, will be described with reference to FIGS. 4A to 4C. FIG. 4A is a schematic diagram illustrating a top surface of the recording element substrate 30. FIG. 4B is a schematic diagram illustrating a section taken along a line X-X' illustrated in FIG. 4A. FIG. 4C is a schematic diagram illustrating a section taken along a line Y-Y' illustrated in FIG. 4A. For ease of explanation, in FIG. 4A, each electric connecting portion 17, which is a main portion, is mainly described, and descriptions of the other portions are omitted. Accordingly, the arrangement and the number of the discharge ports 19 are different from those in the configuration illustrated in FIGS. 2A and 2B. The recording element substrate 30 illustrated in FIG. 4B includes the base portion 1, an electric wiring 22, and an orifice plate 21. The shape, material, and the like of the base portion 1 are not particularly limited. However, in view of controllability of resistance and workability, a silicone substrate is preferably used as the base portion 1. The ink supply port 20 is formed in the base portion 1, and ink supplied from the ink supply port 20 is pressurized by pressure generating elements 18 and discharged from the discharge ports 19. In the present exemplary embodiment, a pressure generating element 18 is a heater. Each pressure generating element 18 generates air bubbles in the ink by heating, and discharges the ink by the bubbling pressure of the air bubbles.

As illustrated in FIG. 4B, the pressure generating elements 18 are electrically connected to the corresponding electric connecting portion 17 through the electric wiring 22, and the electric connecting portion 17 is connected to the outside of the recording element substrate 30 to supply power for driving the pressure generating elements 18, to the pressure generating elements 18. Each recessed portion 3 is formed in the base portion 1 by a so-called dry etching method, and the electric connecting portions 17 are each located at a bottom surface 16 of each recessed portion. As illustrated in FIG. 4C, communicating portions 4 are formed in the base portion 1 in such a manner that spaces formed in a first recessed portion 3*a*, a second recessed portion 3*b*, and a third recessed portion 3*c* communicate with each other. As described in detail below, by providing the communicating portions 4, peeling-off of a dry film resist 2 from a back surface 10 can be prevented when the dry film resist 2 to be described below is subjected to tenting.

The shape of each recessed portion 3 formed in the recording element substrate 30 (FIGS. 6A1 to 6D2) to be described below is different from the shape of each recessed portion 3 illustrated in FIGS. 4A to 4C. The present disclosure is applicable to both configurations. For ease of explanation, FIGS. 4A to 4C more simply illustrates the recording element substrate 30 than the recording element substrate 30 illustrated in FIGS. 6A1 to 6D2.

(Manufacturing Method of Liquid Discharge Head)

Figure 5:
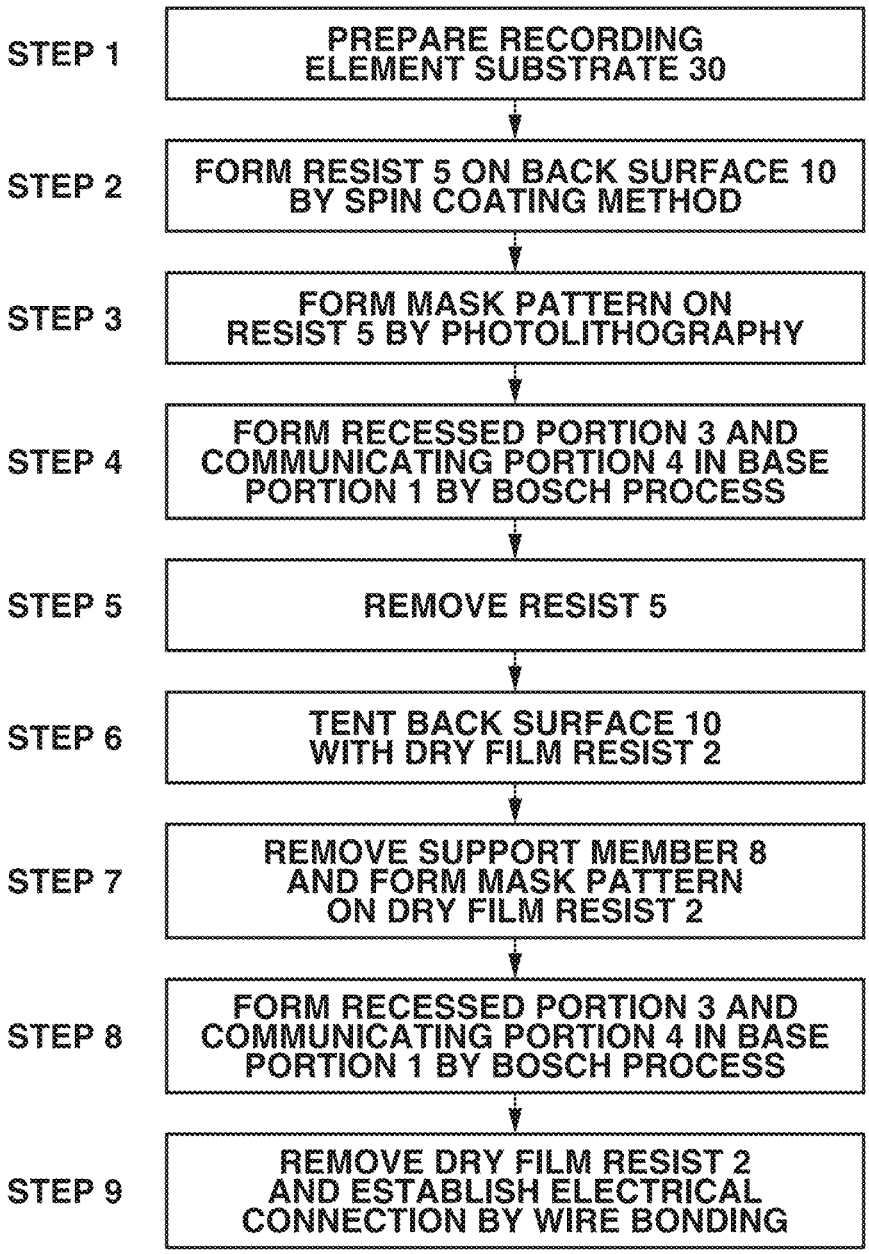
FIG. 5 is a flowchart illustrating manufacturing steps of manufacturing the liquid discharge head.

A manufacturing method of the liquid discharge head 100 according to the present exemplary embodiment will be described with reference to FIGS. 5 to 7E2. FIG. 5 is a flowchart illustrating manufacturing steps of manufacturing the liquid discharge head 100. FIGS. 6A1, 6B1, 6C1, and 6D1, and FIGS. 7A1, 7B1, 7C1, 7D1, and 7E1 are schematic diagrams each illustrating a section taken along the line X-X' illustrated in FIG. 4A and FIGS. 6A2, 6B2, 6C2, and 6D2, and FIGS. 7A2, 7B2, 7C2, 7D2, and 7E2 are schematic diagrams each illustrating a section taken along the line Y-Y' illustrated in FIG. 4A of the recording element substrate 30. FIGS. 6A1 to 6D2 and FIGS. 7A1 to 7E2 respectively correspond to the manufacturing steps illustrated in FIG. 5.

First, the recording element substrate 30 is prepared in which the electric connecting portions 17, the pressure generating elements 18, the discharge ports 19, the electric wiring 22, and the like are formed (step 1 illustrated in FIG. 5 and FIGS. 6A1 and 6A2). Next, a positive resist is coated on the back surface 10 of the recording element substrate 30 by a spin coating method, and is then baked to form a resist 5 with a film thickness 20 μm (step 2 illustrated in FIG. 5 and FIGS. 6B1 and 6B2). Then, a process mask pattern 6 for recessed portions 27, a process mask pattern 13 for the communicating portions 4, and a process mask pattern 15 for the ink supply port 20 are formed in the resist 5 by photolithography (step 3 illustrated in FIG. 5 and FIGS. 6C1 and 6C2).

Next, the base portion 1 was etched by a Bosch process using reactive ion etching (step 4 illustrated in FIG. 5 and FIGS. 6D1 and 6D2). The Bosch process is a method in which formation of a protective film (not illustrated) mainly consisting of carbon and etching using $SF_6$ gas or the like are repeatedly performed to thereby perform anisotropic etching on silicon. The opening width of the process mask pattern 13 for the communicating portions 4 is set smaller than the opening width of the process mask pattern 6 for the recessed portions 27, thereby making it possible to set an etching rate for the recessed portions 27 to be smaller than an etching rate for the communicating portions 4 (micro-loading phenomenon). As a result, the depth of each communicating portion 4 can be set shallower than the depth of each recessed portion 27. As the opening width decreases, the etching rate decreases. This is because ion components or radical components, which contribute to etching, are less likely to enter the etching patterns as the opening width decreases. In the case of etching the base portion 1, $SF_6$ gas is used, while in the case of forming a protective film (not illustrated) on side surfaces of the ink supply port, holes serving as the recessed portions 27, and the communicating portions 4, $C_4F_8$ gas is used.

Next, the protective film (not illustrated) used for the Bosch process in step 4 illustrated in FIG. 5 was removed by hydrofluoroether, and then the resist 5 is removed by using an alkaline removal liquid (step 5 illustrated in FIG. 5 and FIGS. 7A1 and 7A2). Next, the dry film resist 2 which is supported by a support member 8 is prepared and the dry film resist 2 having a film thickness of 30 μm is subjected to tenting on the back surface 10 (step 6 illustrated in FIG. 5 and FIGS. 7B1 and 7B2). The dry film resist 2 was subjected to tenting through the support member 8 in an atmospheric pressure environment, so that dropping of the dry film resist 2 into the inside of each recessed portion 3 could be reduced. This is because, in the atmospheric pressure environment, the pressure in each recessed portion 3 that is covered with the dry film resist 2 becomes an atmospheric pressure or a positive pressure.

Next, the support member 8 was peeled off from the dry film resist 2. Then, a mask pattern for reactive ion etching to be performed in the subsequent step (step 8) is formed on the dry film resist 2 by photolithography (mask pattern forming step) (step 7 illustrated in FIG. 5 and FIGS. 7C1 and 7C2). In this case, a mask pattern corresponding to a region in which the recessed portions 3 are formed is developed in such a manner that each recessed portion 3 takes a desired shape. In the present exemplary embodiment, the mask pattern was developed in such a manner that the recessed portion 3 includes an opening area smaller than the area of each recessed portion 3 that was formed by etching in the previous step.

Next, the base portion 1 was bored by the Bosch process using reactive ion etching until the ink supply port 20 is connected to a channel 26 for supplying a liquid to a pressure chamber 25 that communicates with the discharge ports 19 and until each electric connecting portion 17 is exposed (step 8 illustrated in FIG. 5 and FIGS. 7D1 and 7D2). In this case, the mask pattern is formed with an opening portion smaller than that formed in the previous etching. Accordingly, etching is performed so as to obtain two opening areas in which the recessed portions 3 have different shapes as illustrated in FIG. 7D1. Specifically, in a direction perpendicular to a height direction of each recessed portion 3, the area of the recessed portion 3 at a location where the corresponding electric connecting portion 17 is formed is smaller than the area of the recessed portion 3 located on the back surface of a discharge port surface. The opening width of each communicating portion 4 is smaller than the opening width of each recessed portion 3. Accordingly, the depth of each communicating portion 4 can be set shallower than the depth of each recessed portion 3 due to the micro-loading phenomenon described above, and thus it can be expected that the present disclosure is applicable to a case where the bottom surfaces 16 of the adjacent recessed portions 3 become independent from each other. Next, the dry film resist 2 was removed (step 9 illustrated in FIG. 5 and FIGS. 7E1 and 7E2). After that, the electric connecting portions 17 and the terminals 51 of the electric wiring members 31 (FIGS. 2A and 2B) are electrically connected by way of the metal wire 7, and the sealing member 63 (FIGS. 3A and 3B) is injected into the recessed portions 3, thereby manufacturing the liquid discharge head 100. The liquid discharge head 100 was evaluated and, a phenomenon in which the dry film resist 2 is peeled off from the back surface 10 of the recording element substrate 30 was not observed.

In a case where the bottom surfaces 16 of the adjacent recessed portions 3 are formed separately to be independent from each other, or in a case where a higher rigidity of the recording element substrate 30 is secured, the opening width of each communicating portion 4 is preferably smaller as much as possible than the opening width of each recessed portion 3. However, in view of the processing accuracy of reactive ion etching or the like, the opening width of each communicating portion 4 is preferably more than or equal to 4 μm. Assuming that the opening width of each recessed portion 3 is "1", the ratio between the opening width of each recessed portion 3 and the opening width of each communicating portion 4 is preferably less than "1". With this configuration, the depth of each recessed portion 3 and the depth of each communicating portion 4 can be selectively set. For example, assuming that the opening width of each communicating portion 4 is 100 μm and the opening width of each recessed portion 3 is 550 μm, the ratio between the depth of each recessed portion 3 and the depth of each communicating portion 4 is 1:0.8.

The present exemplary embodiment illustrates an example in which the Bosch process using reactive ion etching is used for the etching step of etching the base portion 1. However, the etching step according to the present disclosure is not limited to this example. Other examples of the etching method include laser processing, sandblasting, and wet etching. However, in view of the processing accuracy (width dimensional accuracy or depth dimensional accuracy) and the obtained shape (anisotropy), the base portion 1 is preferably formed by the Bosch process using reactive ion etching. In the present exemplary embodiment, the dry film resist 2 is removed after the base portion 1 is etched. However, the dry film resist 2 need not necessarily be removed and may be left. In the present exemplary embodiment, as described above, the dry film resist 2 is used to form the recessed portions 3 with different diameters depending on the location. The dry film resist 2 can be used not only for the above-described application, but also for various applications. The present disclosure is applicable to a case where the dry film resist 2 is subjected to tenting on the base portion 1.

(Tenting of Dry Film Resist)

Figure 8:
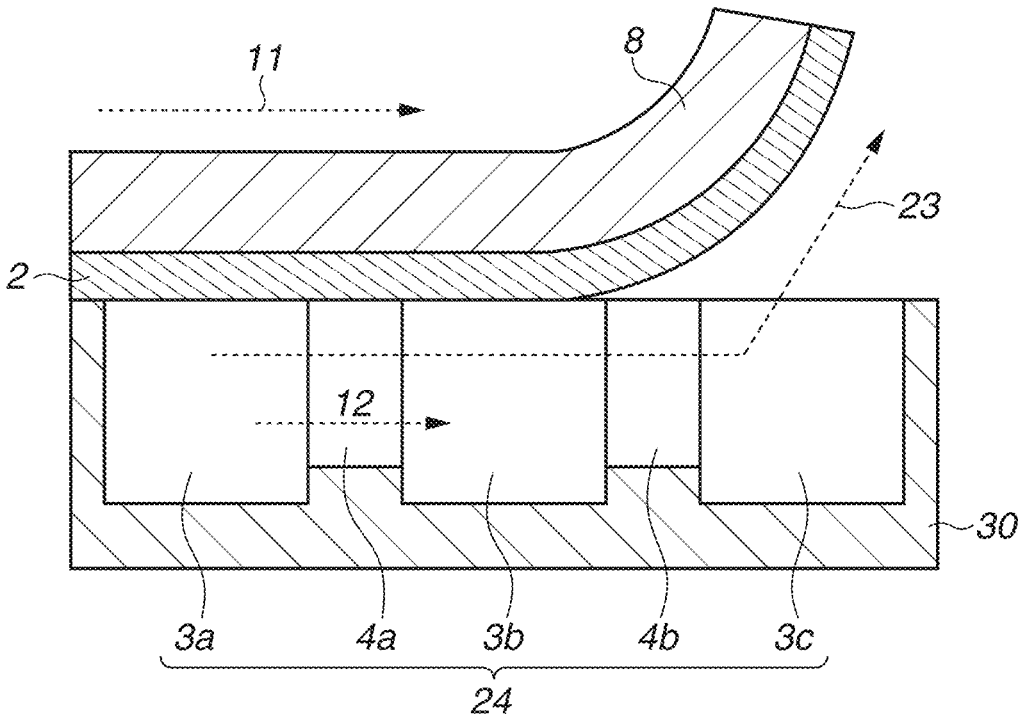
FIG. 8 is a schematic diagram illustrating a state where a dry film resist is subjected to tenting.

Next, an advantageous effect of the present disclosure in step 6 (dry film resist is subjected to tenting) illustrated in FIG. 5 will be described in detail with reference to FIG. 8. FIG. 8 is a schematic diagram illustrating an air flow in each recessed portion 3 and a tenting direction when the dry film resist 2 is subjected to tenting on the back surface 10 of the recording element substrate 30. For ease of explanation, the recording element substrate 30 is illustrated in a simplified manner in FIG. 8.

When the dry film resist 2 is subjected to tenting in a direction indicated by an arrow 11, the first recessed portion 3*a* is first covered. In this case, the air in the first recessed portion 3*a* that is pressurized due to a transfer pressure applied during tenting, heat applied during tenting, or the like flows through a first communicating portion 4*a* which is adjacent to the first recessed portion 3*a*. Next, when a second communicating portion 4*b* is covered with the dry film resist 2, the pressurized air flows into the second recessed portion 3*b* that is formed adjacent to the second communicating portion 4*b*. Along with the advancement of the tenting process, an air flow 12 is sequentially generated and the pressurized air passes through the third recessed portion 3*c* and is finally discharged into the atmosphere. In other words, the air in each recessed portion 3 also moves along the tenting direction 11. Thus, the communicating portions 4 connect the spaces formed in the adjacent recessed portions 3, so that an air escape route 23 can be formed and the pressurized air can be released. Accordingly, when the dry film resist 2 is subjected to tenting as illustrated in FIGS. 7A1 to 7E2, the tenting direction 11 preferably coincides with the array direction of the recessed portions 3.

The pressurized air is released into the atmosphere and the pressure in each recessed portion 3 is decreased, thereby preventing the dry film resist 2 from being peeled off from the back surface 10 of the recording element substrate 30. The volume of an opening portion 24 can be increased in the present exemplary embodiment in which the recessed portions 3 communicate with each other as compared with a case where the first recessed portion 3*a*, the second recessed portion 3*b*, and the third recessed portion 3*c* are formed separately from each other. Therefore, even if the pressurized air remains in each recessed portion 3, the pressure can be distributed with a larger volume, thereby preventing the dry film resist 2 from being peeled off from the back surface 10 as compared with the case where the recessed portions 3 are formed separately from each other.

Figure 9A:
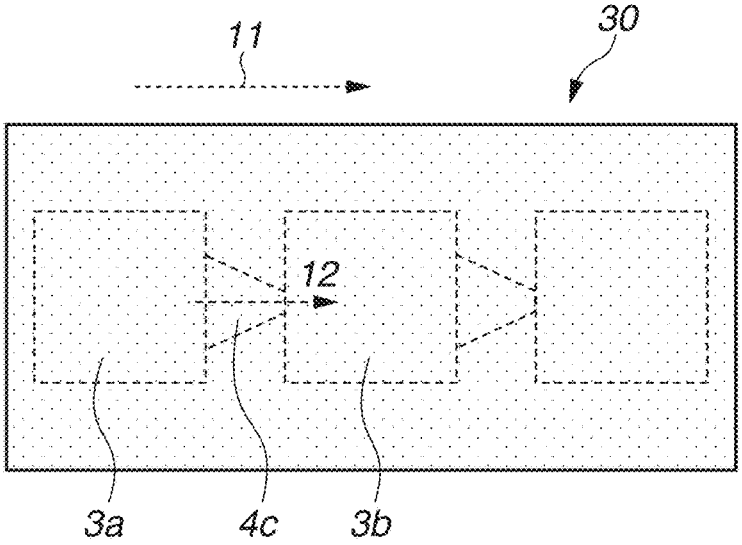
FIGS. 9A to 9C are schematic diagrams illustrating the recording element substrate according to a second exemplary embodiment.
Figure 9B:
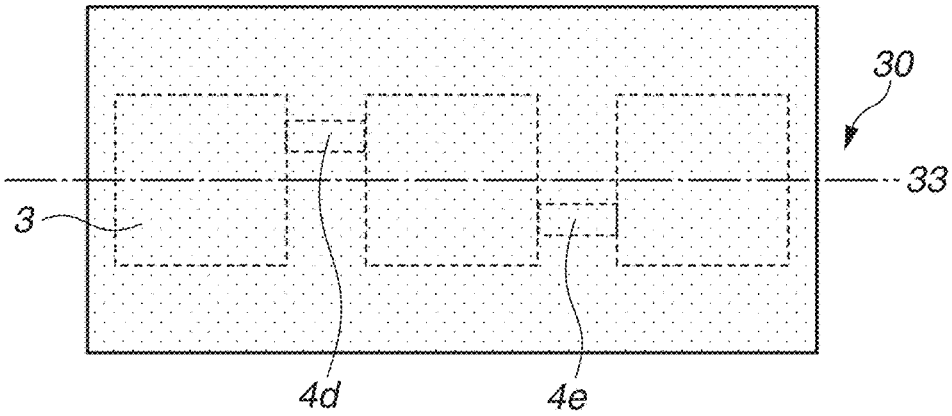
Figure 9C:
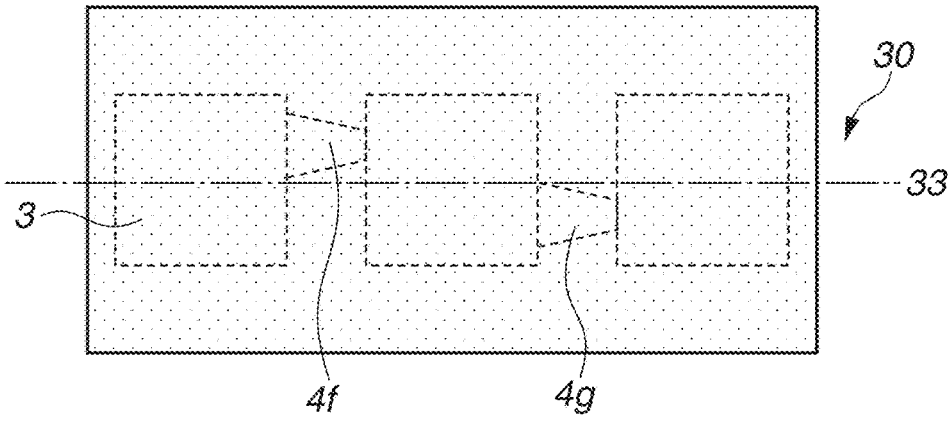

A second exemplary embodiment which is configured to prevent the dry film resist 2 from being peeled off from each recording element substrate 30 will be described with reference to FIGS. 9A to 9C. FIGS. 9A to 9C are schematic diagrams each illustrating a modified example of the configuration of each communicating portion 4. FIG. 9A is a schematic diagram illustrating the recording element substrate 30 including the communicating portions 4 each having a configuration in which an opening width of a communicating portion 4*c* on the left side of FIGS. 9A to 9C gradually decreases from a portion on the first recessed portion 3*a* toward a portion on the second recessed portion 3*b*.

In this configuration, the opening width of the communicating portion 4*c* at an upstream side of the air flow 12 can be increased. This configuration enables the air pressured by tenting in each recessed portion 3 to easily escape in the tenting direction 11. In other words, the pressure in each recessed portion 3 can be rapidly reduced. Accordingly, the recording element substrate 30 illustrated in FIG. 9A can prevent the peeling-off of the dry film resist 2 from the back surface 10 (not illustrated) as compared with the recording element substrate 30 according to the first exemplary embodiment. Also, in the configuration illustrated in FIG. 9A, the opening width of each communicating portion 4 is smaller than the opening width of each recessed portion 3, and thus the bottom surfaces 16 of the adjacent recessed portions 3 can be formed separately from each other due to the micro-loading phenomenon described above.

Next, FIG. 9B illustrates a schematic diagram of a configuration that improves the rigidity of the recording element substrate 30. As illustrated in FIG. 9B, the configuration is characterized in that a first communicating portion 4*d* and a second communicating portion 4*e* are arranged at locations deviating from a line 33 that connects midpoints of the sides of the recessed portions 3 and is perpendicular to the array direction of the recessed portions 3. If the first communicating portion 4*d* and the second communicating portion 4*e* are arranged on the line 33, the first communicating portion 4*d* and the second communicating portion 4*e* may become a fracture origin and the recording element substrate 30 may be cracked. On the other hand, in the configuration illustrated in FIG. 9B, the first communicating portion 4*d* and the second communicating portion 4*e* are not arranged on the line 33. Accordingly, the first communicating portion 4*d* and the second communicating portion 4*e* can be prevented from becoming the fracture origin. Thus, the rigidity of the recording element substrate 30 illustrated in FIG. 9B can be improved as compared with the rigidity of the recording element substrate 30 according to the first exemplary embodiment.

Next, FIG. 9C illustrates a configuration that improves the rigidity of the recording element substrate 30 while preventing the peeling-off of the dry film resist 2 from the back surface 10 (not illustrated). This configuration is characterized in that the opening width of each communicating portion 4 at the upstream side of the air flow 12 is increased and a communicating portion 4*f* and a communicating portion 4*g* are not arranged on the line 33. This configuration enables the air pressurized by tenting in each recessed portion 3 to easily escape in the tenting direction 11, and the communicating portion 4*f* and the communicating portion 4*g* can be prevented from becoming a fracture origin. A method for manufacturing the recording element substrate 30 illustrated in FIGS. 9A to 9C is similar to the method described in the first exemplary embodiment, and thus the description thereof is omitted.

The liquid discharge head 100 according to a third exemplary embodiment will be described with reference to FIGS. 10A and 10B. Components that are similar to those in the first exemplary embodiment are denoted by the same reference numerals and descriptions thereof are omitted. The present exemplary embodiment is characterized in that a cover member 110 is attached to the discharge port surface on which the discharge ports 19 of the liquid discharge head 100 are formed.

Figure 10A:
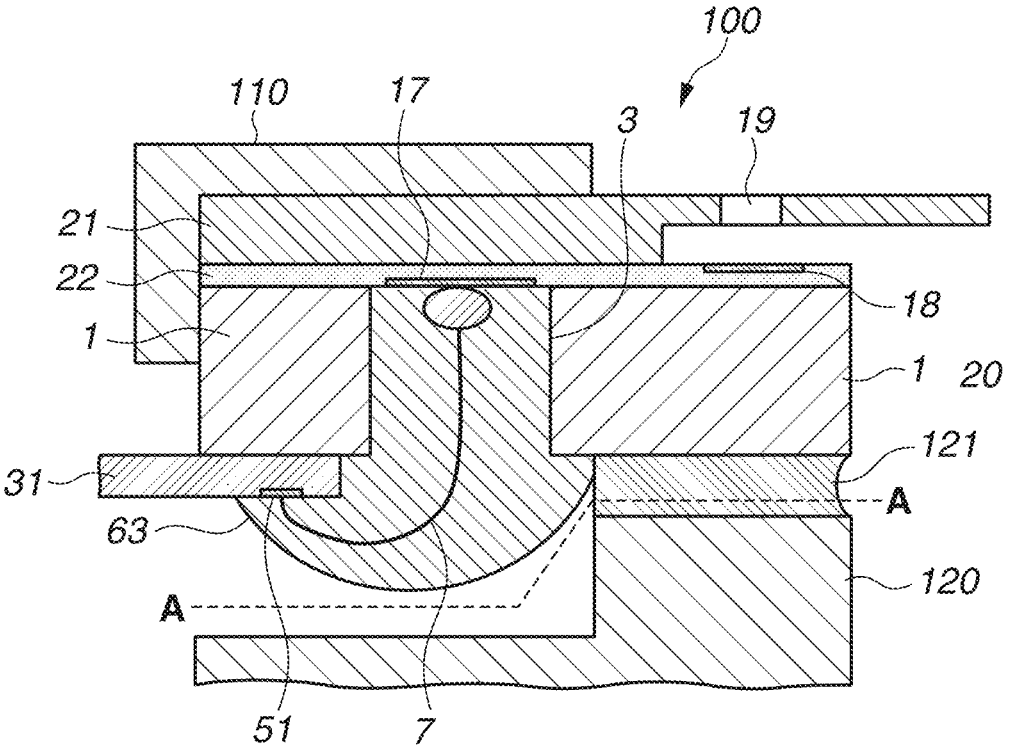
FIG. 10A is a schematic diagram illustrating a part of the recording element substrate as viewed along a line B-B illustrated in FIG. 2B.
Figure 10B:
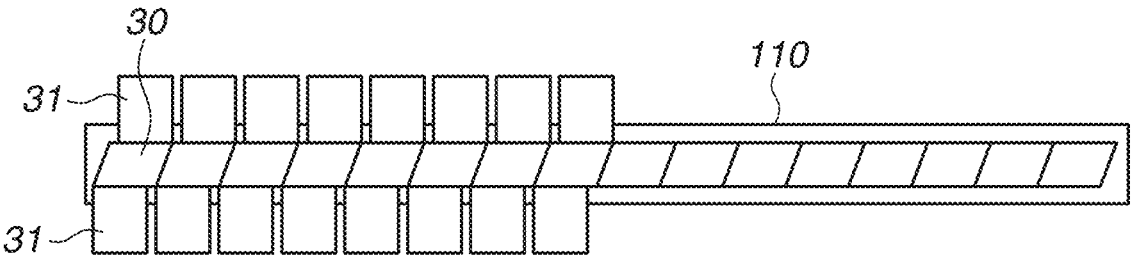
FIG. 10B is a schematic diagram illustrating a plurality of recording element substrates attached to a cover member and the cover member as viewed from the back surface side of the recording element substrates.

FIG. 10A is a schematic diagram illustrating a part of the recording element substrate 30 as viewed along the line B-B illustrated in FIG. 2B. FIG. 10B is a schematic diagram illustrating the plurality of recording element substrates 30, which is attached to a cover member 110, and the cover member 110 as viewed from the back surface side of the recording element substrates 30. As illustrated in FIG. 10B, the cover member 110 has a frame body shape including an opening portion through which the recording element substrates 30 are exposed and the inner surface side of the frame body and the recording element substrates 30 are fixed with an adhesive agent (not illustrated).

Since the recessed portions 3 and the communicating portions 4 are formed on the back surfaces of the recording element substrates 30, the thickness of each recording element substrate 30 at a location where the recessed portions 3 and the communicating portions 4 are formed decreases and thus the strength of each recording element substrate 30 decreases, which may cause deformation or cracking of each recording element substrate 30. In the present exemplary embodiment, the cover member 110 is provided so as to correspond to a location where each recessed portion 3 is provided. That is, as viewed from the discharge port surface, the recessed portions 3 and the frame portion of the cover member 110 are located at overlapping positions. Accordingly, the present exemplary embodiment is preferable in that the strength at the location where each recessed portion 3 of the recording element substrate 30 is formed is improved. As the material of the cover member 110, various materials such as resin or metal can be applied. In terms of strength, metal such as Steel Use Stainless (SUS) is preferably used. Although resin can be applied, resin containing a filler is preferably applied in terms of strength.

COMPARATIVE EXAMPLE

Figure 11A:
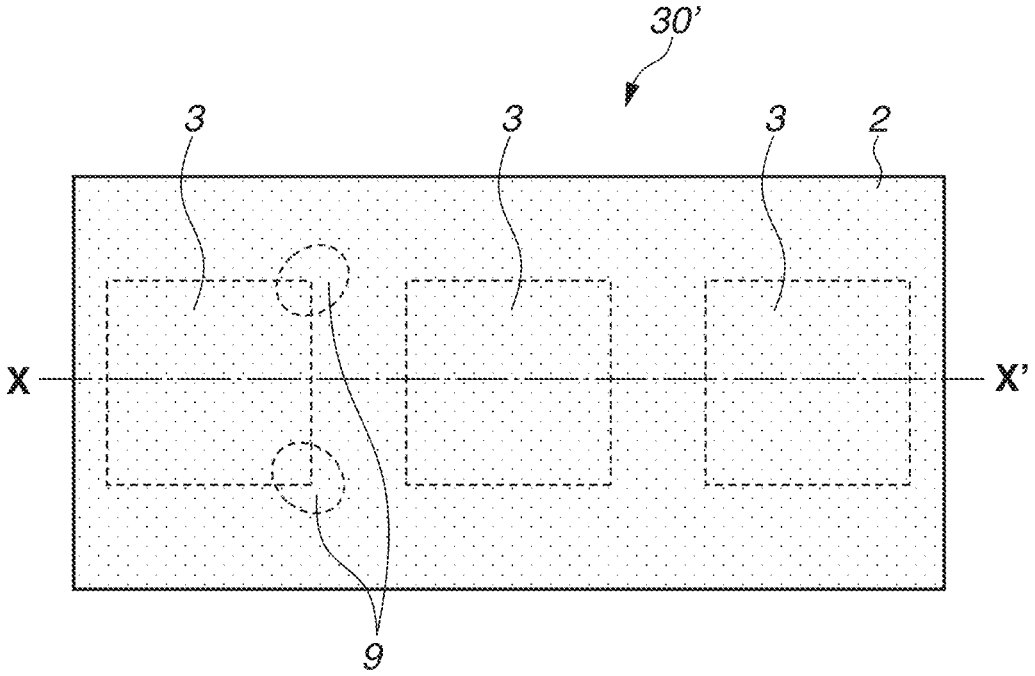
FIG. 11A is a top view illustrating an example of a recording element substrate according to a comparative example.
Figure 11B:
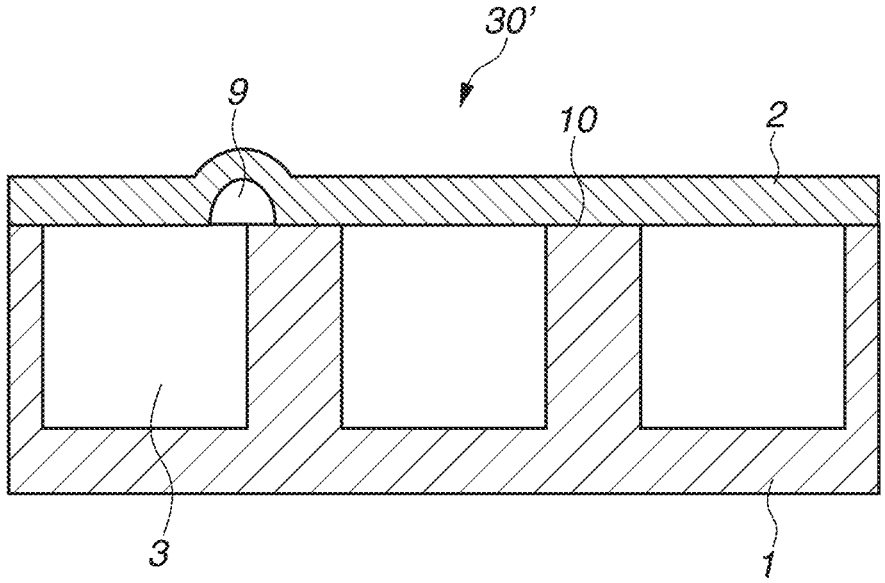
FIG. 11B is a schematic diagram illustrating the recording element substrate taken along a line X-X' illustrated in FIG. 11A.

A comparative example of the present disclosure will be described with reference to FIGS. 11A and 11B. FIG. 11A is a top view illustrating an example of a recording element substrate 30' according to the comparative example. FIG. 11B is a schematic diagram illustrating the recording element substrate 30' at a section taken along a line X-X' illustrated in FIG. 11A. The recording element substrate 30' according to the comparative example differs from the recording element substrate 30 according to the present disclosure described above in that the communicating portions 4 are not formed in the recording element substrate 30'. The other components and the manufacturing method in the comparative example are identical to those in the first exemplary embodiment, and thus descriptions thereof are herein omitted.

As a result of evaluating the recording element substrate 30' according to the comparative example, phenomena in which the dry film resist 2 formed on the back surface 10 of the recording element substrate 30' in which the plurality of recessed portions 3 is formed is peeled off from the back surface 10 are in many cases observed. The phenomena occur because the communicating portions 4 are not formed in the recording element substrate 30' and there is no escape route for the air in each recessed portion 3, which is pressurized by tenting, so that the air remains in each recessed portion 3. Thus, as illustrated in FIG. 11B, the pressurized air remaining in each recessed portion 3 causes peeling-off of the dry film resist 2 to start in opening edge neighboring portions 9 of each recessed portion 3.

However, as described above in the exemplary embodiments of the present disclosure, the formation of the communicating portions 4 that communicate with the plurality of recessed portions 3 can prevent the peeling-off of the dry film resist 2. In the exemplary embodiments described above, the communicating portions 4 are formed on the back surface of the base portion 1 by etching. However, the present disclosure is not limited to this configuration. The shape, position, and manufacturing method of the communicating portions 4 are not particularly limited as long as the communicating portions 4 that enable the recessed portions 3 to communicate with each other and connect the spaces formed in the respective recessed portions 3 are provided.

According to the present disclosure, it is possible to provide a liquid discharge head that prevents the peeling-off of a dry film resist from a recording element substrate, and a manufacturing method of the liquid discharge head.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-157380, filed Aug. 24, 2018, which is hereby incorporated by reference herein in its entirety.

What is claimed is:

1. A liquid discharge head comprising:

a recording element substrate including:

a discharge port configured to discharge a liquid, a pressure generating element configured to pressurize the liquid to discharge the liquid, and an electric connecting portion connected to the pressure generating element through an electric wiring and configured to supply power for driving the pressure generating element to the pressure generating element;

a first recessed portion and a second recessed portion formed in a range from a back surface of a discharge port surface in which the discharge port of the recording element substrate is formed, up to the electric connecting portion; and a communicating portion configured to connect a space formed within the first recessed portion and a space formed within the second recessed portion by allowing the first recessed portion and the second recessed portion to communicate with each other.

2. The liquid discharge head according to claim 1, wherein the first recessed portion and the second recessed portion are adjacent to each other in an array direction of the electric connecting portion.

3. The liquid discharge head according to claim 1, wherein the communicating portion is formed on the back surface of the recording element substrate.

4. The liquid discharge head according to claim 1, wherein a volume of a space formed in the communicating portion is smaller than a volume of a space formed in each of the first and second recessed portions.

5. The liquid discharge head according to claim 1, wherein a height of the communicating portion is lower than a height of each of the first and second recessed portions.

6. The liquid discharge head according to claim 1, wherein in a direction perpendicular to a height direction of each of the first and second recessed portions, an area of each of the first and second recessed portions on the back surface is larger than an area of each of the first and second recessed portions at a location where the electric connecting portion is provided.

7. The liquid discharge head according to claim 1, wherein the communicating portion is arranged at a location deviating from a line connecting midpoints of sides of each of the first and second recessed portions, the sides being perpendicular to an array direction of the first and second recessed portions.

8. The liquid discharge head according to claim 1, wherein a width of the communicating portion in a direction intersecting with an array direction of the first and second recessed portions gradually decreases in a direction from the first recessed portion to the second recessed portion.

9. The liquid discharge head according to claim 1, wherein the pressure generating element is a heater configured to heat the liquid.

10. The liquid discharge head according to claim 1, wherein a plurality of the recording element substrates is linearly arranged in a longitudinal direction of the liquid discharge head.

11. The liquid discharge head according to claim 1, wherein a plurality of the recording element substrates is arranged in a staggered manner in a longitudinal direction of the liquid discharge head.

12. The liquid discharge head according to claim 1, wherein the liquid discharge head is a page-wide liquid discharge head in which a plurality of the recording element substrates is arranged.

13. The liquid discharge head according to claim 1, further comprising a cover member configured to cover a surface of the liquid discharge head on which the discharge port surface is formed.

14. The liquid discharge head according to claim 1, further comprising an electric wiring member electrically connected through the electric connecting portion and a wire and configured to supply the power to the electric connecting portion, wherein a sealing member for covering a connecting portion between the electric connecting portion and the wire and a connecting portion between the electric wiring member and the wire fills in each of the first and second recessed portions.

15. A recording element substrate comprising:

a discharge port configured to discharge a liquid;

a pressure generating element configured to pressurize the liquid to discharge the liquid;

an electric connecting portion connected to the pressure generating element through an electric wiring and configured to supply power for driving the pressure generating element to the pressure generating element;

a first recessed portion and a second recessed portion formed in a range from a back surface of a discharge port surface in which the discharge port of the recording element substrate is formed, up to the electric connecting portion; and a communicating portion configured to connect a space formed in the first recessed portion and a space formed in the second recessed portion by allowing the first recessed portion and the second recessed portion to communicate with each other.

* * * * *